US009206973B2

(12) United States Patent
Fussell

(10) Patent No.: US 9,206,973 B2
(45) Date of Patent: Dec. 8, 2015

(54) LIGHT HEAD

(76) Inventor: Simon Fussell, London (GB)

( * ) Notice: Subject to any disclaimer, the term of this patent is extended or adjusted under 35 U.S.C. 154(b) by 177 days.

(21) Appl. No.: 13/809,727

(22) PCT Filed: Jul. 8, 2011

(86) PCT No.: PCT/GB2011/051285

§ 371 (c)(1),
(2), (4) Date: Mar. 26, 2013

(87) PCT Pub. No.: WO2012/007738

PCT Pub. Date: Jan. 19, 2012

(65) Prior Publication Data

US 2013/0176734 A1 Jul. 11, 2013

(30) Foreign Application Priority Data

Jul. 12, 2010 (GB) ..... 1011703.4

(51) Int. Cl.

| | |
|---|---|
| ***F21S 8/00*** | (2006.01) |
| ***F21V 29/00*** | (2015.01) |
| ***F21S 6/00*** | (2006.01) |
| ***F21S 8/02*** | (2006.01) |
| ***F21V 21/00*** | (2006.01) |
| ***F21V 29/83*** | (2015.01) |
| ***F21V 29/89*** | (2015.01) |
| *F21W 131/10* | (2006.01) |
| *F21Y 101/02* | (2006.01) |
| *F21Y 103/02* | (2006.01) |

(52) U.S. Cl.

CPC ..... *F21V 29/22* (2013.01); *F21S 6/003* (2013.01); *F21S 6/006* (2013.01); *F21S 8/02* (2013.01); *F21S 8/026* (2013.01); *F21V 21/00* (2013.01); *F21V 29/004* (2013.01); *F21V 29/83* (2015.01); *F21V 29/89* (2015.01); *F21W 2131/10* (2013.01); *F21Y 2101/02* (2013.01); *F21Y 2103/022* (2013.01)

(58) Field of Classification Search

CPC ..... F21V 29/02; F21V 29/2293; F21V 29/89; F21V 29/83; F21S 6/003

USPC ..... 362/147, 249.02, 294, 373, 410, 414

See application file for complete search history.

(56) References Cited

U.S. PATENT DOCUMENTS

| | | | | |
|---|---|---|---|---|
| 1,637,786 | A * | 8/1927 | Rekar | 362/294 |
| 3,689,761 | A | 9/1972 | Rosen et al. | |
| 6,024,468 | A | 2/2000 | Kassay et al. | |
| 7,144,140 | B2 * | 12/2006 | Sun et al. | 362/373 |
| 7,367,690 | B2 * | 5/2008 | Chen | 362/285 |

(Continued)

FOREIGN PATENT DOCUMENTS

| | | | |
|---|---|---|---|
| EP | 2128522 | A1 | 12/2009 |
| EP | 2151626 | A1 | 2/2010 |
| WO | 2009039907 | A1 | 4/2009 |

OTHER PUBLICATIONS

GB Search Report, Application No. 1011703.4 dated Nov. 5, 2010 (2 pages).

*Primary Examiner* — Peggy Neils

(74) *Attorney, Agent, or Firm* — Ware, Fressola, Maguire & Barber LLP

(57) ABSTRACT

A light head (2) comprises a body (11) for supporting a light source module (21). The body is configured to provide a flared passage passing through the body for cooling the light head. The flared passage forms a convection chimney in which heat can accelerate up the convection chimney.

18 Claims, 6 Drawing Sheets

(56) References Cited

U.S. PATENT DOCUMENTS

| | | | | |
|---|---|---|---|---|
| 7,841,752 | B2 * | 11/2010 | Lee | 362/373 |
| 8,100,556 | B2 * | 1/2012 | Patrick et al. | 362/249.02 |
| 8,143,769 | B2 * | 3/2012 | Li | 313/46 |
| 8,376,593 | B2 * | 2/2013 | Bazydola et al. | 362/373 |
| 8,419,238 | B2 * | 4/2013 | Robinson | 362/373 |
| 2008/0002399 | A1 * | 1/2008 | Villard et al. | 362/184 |
| 2009/0067182 | A1 | 3/2009 | Hsu et al. | |
| 2009/0073688 | A1 | 3/2009 | Patrick | |
| 2009/0296411 | A1 | 12/2009 | Chang et al. | |
| 2009/0310373 | A1 * | 12/2009 | Burkhauser | 362/373 |
| 2010/0046226 | A1 * | 2/2010 | Cox et al. | 362/249.06 |
| 2010/0118541 | A1 | 5/2010 | Li | |
| 2010/0128475 | A1 * | 5/2010 | Kovalchick et al. | 362/235 |
| 2010/0149818 | A1 | 6/2010 | Ruffin | |
| 2011/0063843 | A1 * | 3/2011 | Cook | 362/249.02 |

* cited by examiner

LIGHT HEAD

FIELD OF THE INVENTION

The present invention relates to a light head for a luminaire.

BACKGROUND

A luminaire (which can also be referred to as a "light fitting" or "light fixture", or colloquially as a "lamp" or "light") has a light head which houses a light source. The light head can be cooled using a heat sink, for example as described WO 2009 039907 A.

SUMMARY

The present invention seeks to provide an improved light head.

According to the present invention there is provided light head comprising a body for supporting a light source module, wherein the body is configured to provide a flared passage passing through the body for cooling the light head.

Thus, the passage provides a convection chimney. The flared (or "trumpet-shaped") profile can help to accelerate heat up the passage and away from the light head.

The body may be configured to receive the light source module at a position at or close to an end of the body and the passage becomes wider further away from the end of the body. The body may lie between first and second ends. The first end of the body may be configured to receive a light source module. The passage may pass through the body between the first and second ends and may be narrower at the first end and wider at the second end.

The flared passage may have openings at first and second ends of the body. The opening at the second end may be at least about four times, about nine times, about sixteen times or about twenty five times the area of the opening at the first end of the body. The passage may have a length, a maximum width and an aspect ratio, which is calculated by dividing the length by the maximum width, which does not exceed about 3 or about 2.5.

The body or the part of the body defining the passage may be smooth and continuous, and may be polished. This can help to promote smooth airflow. The body or the part of the body defining the passage may be formed from a material having a high thermal conductivity (i.e. greater than about 100 $W\,m^{-1}\,K^{-1}$), such as aluminium. The body may comprise a demi-toroidal shell which defines the passage. The body may comprise a cylinder. The body may be adapted to receive the light source module outside the passage. The body may have a recess and/or securing points for receiving the light source module The light head may further include a light source module received and thermally anchored to the body. The light source module may include at least one light source. The light source module comprises a circuit board, supporting at least one light source. The at least one light source may comprise a plurality of light emitting diodes, for example, 5, 6 or 7 light emitting diodes. The light head may be capable of producing at least 60 lumens per Watt.

According to a second aspect of the present invention there is provided a luminaire comprising the light head. The luminaire may be a balanced-arm lamp, a ceiling light or a wall-mounted lamp.

BREIF DESCRIPTION OF THE DRAWINGS

Embodiments of the present invention will now be described, by way of example, with reference to the accompanying drawings in which.

DETAILED DESCRIPTION OF CERTAIN EMBODIMENTS

Figure 1:
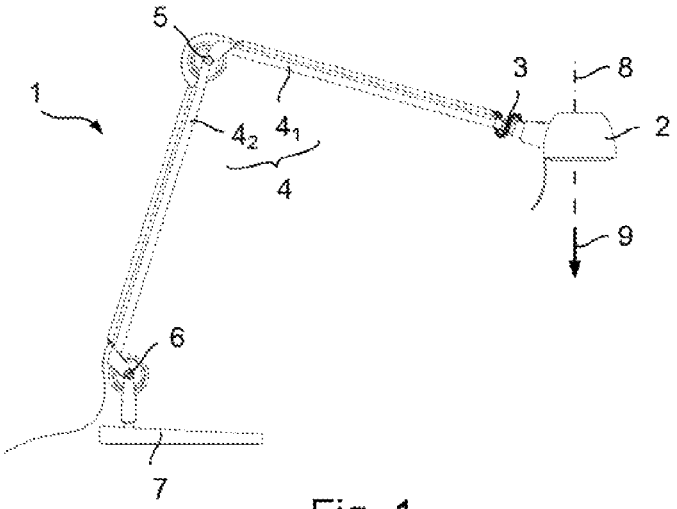
FIG. 1 is a side view of a luminaire which includes an embodiment of a light head in accordance with the present invention.
Figure 2:
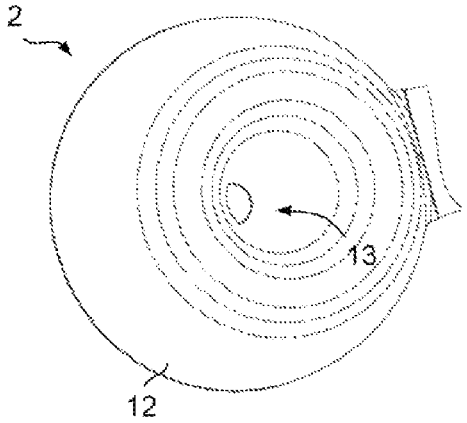
FIG. 2 is a perspective view, from above, of the light head shown in FIG. 1.
Figure 3:
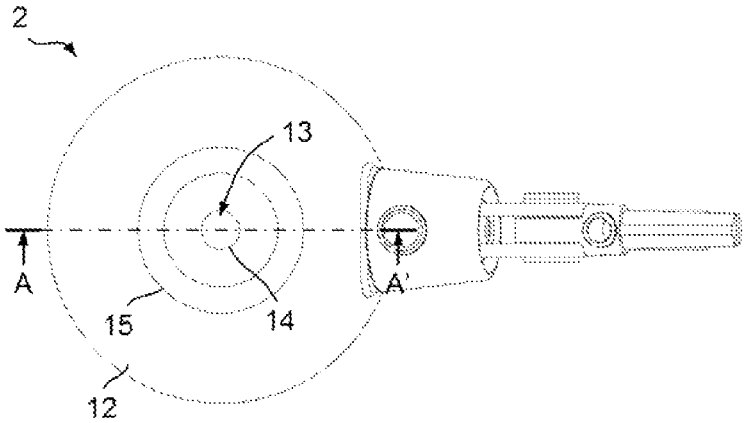
FIG. 3 is a plan view of the light head shown in FIG. 1.
Figure 4:
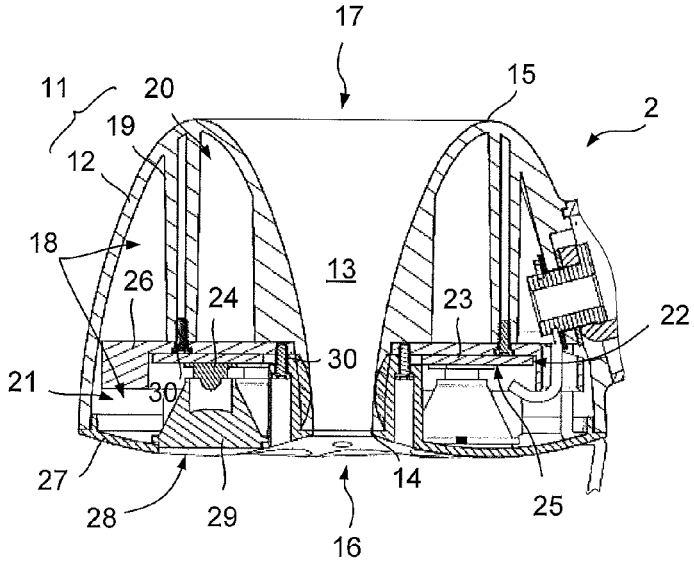
FIG. 4 is a sectional view of the light head shown in FIGS. 1 and 3 taken along the line A-A'.
Figure 5:
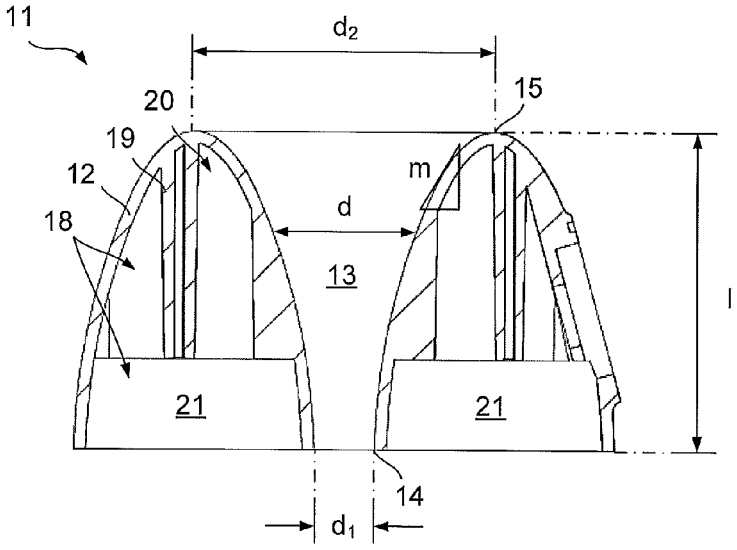
FIG. 5 is a sectional view of the body of the light head shown in FIG. 1.
Figure 6:
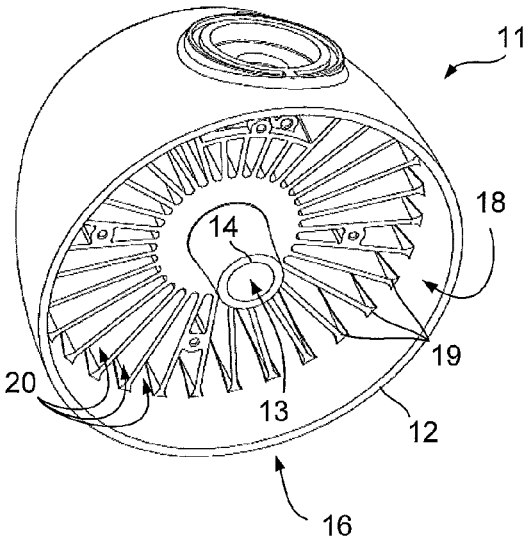
FIG. 6 is a perspective view, from below, of the body of the light head shown in FIG. 1.
Figure 7:
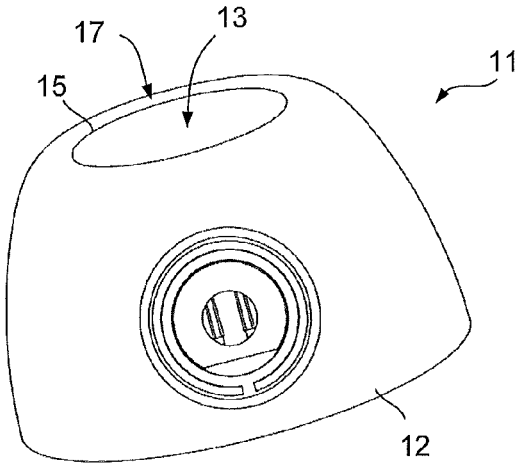
FIG. 7 is a perspective view, from the side, of the body of the light head shown in FIG. l.
Figure 8:
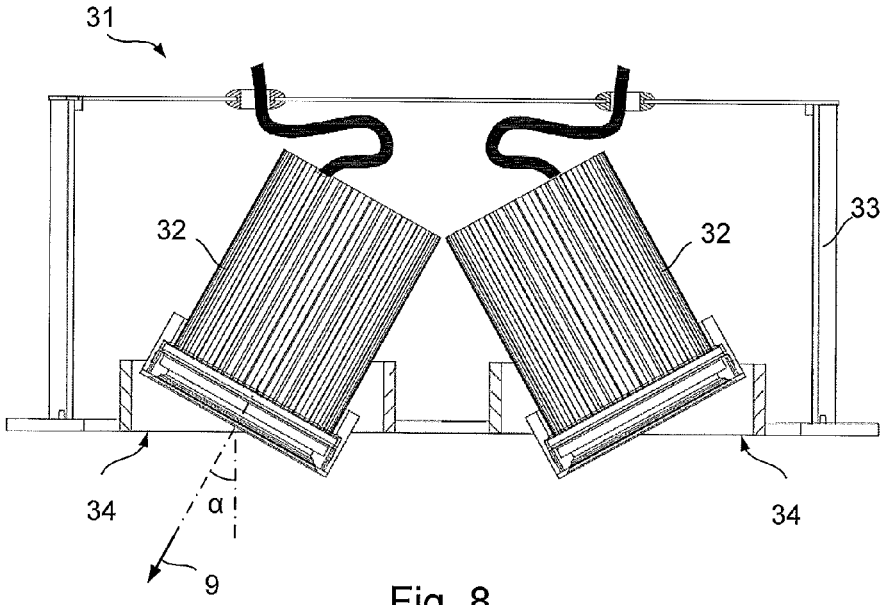
FIG. 8 is a sectional view of another luminaire which includes another embodiment of a light head.

Referring to FIG. 1, a luminaire 1 in the form of a balanced-arm lamp is shown. The luminaire 1 includes a generally domed-shaped light head 2 attached by a first joint 3 to a first end of an bendable arm arrangement 4 having first and second arms $\mathbf{4}_1$, $\mathbf{4}_2$ connected via a second joint 5. A second, opposite end of the arm arrangement 4 is attached by a third joint 6 to a base 7.

As shown in FIG. 1, the light head 2 has a central axis 8 and emits light generally along the central axis 8 in a forwards direction 9. The light head 2 is orientated to emit light downwards.

Referring to FIGS. 2 to 8, the light head 2 includes a die cast body 11 formed from aluminium. The body 11 has an outer diameter of about 90 mm and a height (or length) of about 55 mm. The body 11 includes a demi-toroidal shell 12 which defines a central passage 13 through the middle of the light head 2 between first and second openings 14, 15. A part of the shell 12 forming the passage 13 is smooth and continuous and has a trumpet-like profile (which may also be referred to as "bell-shaped" or "campanulate"). The passage 13 is relatively narrow at the first opening 14 at the front 16 of the light head 2 and relatively wide at the second opening 15 at the back 17 of the light head 2. The first opening 14 has a diameter, $d_1$, of about 10 mm and the second opening 15 has a diameter, $d_2$, of about 50 mm. The passage 13 has a length, l, of about 55 mm. Thus, the passage 13 is flared having a diameter, d, which increases smoothly and monotonically from the front 16 to the back 17 of the light head 2. The magnitude of the gradient, m, of the wall decreases along the passage 13 thereby defining a trumpet-shaped profile. For example, a first gradient $|m_1|$ closer to the front 16 of the light head is larger than a second gradient $|m_1|$ closer to the back 17 of the light head 2. Put differently, the rate at which the diameter, d, of the passage 13 increases along the passage increases from the front 16 to the back 17 of the light head 2 (i.e. increasing divergence along the passage).

The shell 12 also defines a ring-shaped cavity 18. The body 11 includes radial support members 19 which divide the cavity 18 into a plurality of segments 20. A forward portion of the cavity 18 is left to provide an annular recess 21 in a forward section of the body.

The light head 2 includes a light source module 22 comprising a printed circuit board 23 which, among other things, supports a plurality of light sources 24 on one face 25. The light sources 24 take the form of light emitting diodes. Light emitting diodes are generally energy efficient. There are seven light emitting diodes, each rated at 1.3 W, collectively producing about 700 lm at 425 mA. The module 22 is seated in the annular recess 21 of the body 11 on an annular disc 26 formed of aluminium, with the light emitting diodes 24 facing forwards.

The module 22 is covered by a face plate 27 formed of aluminium having apertures 28. The light emitting diodes 23 are covered by respective lenses 29 for collimating light to a given beam angle, for example 8°. The face plate 27 is annular and so does not cover the front opening 14. The module 22, disc 26 and face plate 27 are secured to the body 11 by screws 29.

The module 22 is generally disposed outside the central passage 13, proximate to the first opening 14 of the passage 13. The module 22 is configured to be in good thermal contact with, i.e. thermally anchored to, the body 11.

The flared passage 13 provides a convection chimney for cooling the light head 2. In use, the module 22 generates heat which heats up the body 11, particularly at the front 16 of the light head 2. Air enters the front opening 14, is heated by the body 11 and rises up the convection chimney, i.e. the passage 13. The passage 13 spreads or diverges running away from the light source module 22, i.e. in the direction of air flow.

The light head 2 is typically orientated so that its central axis 8 and, thus, that of the passage 13 is vertical (i.e. 0°) or close to vertical (i.e. tilted up to about 30° from vertical). Air flow arising from natural convection still occurs even when the light head 2 is tilted 30° from vertical.

The flared profile of the convection chimney helps extract heat and, thus, provides more effective cooling compared with, for example, a chimney having the same diameter along its length or which has a conical-profile (where the rate at which the diameter of the passage increases along the passage is constant along the passage, i.e. constant divergence along the passage) or which has a cup-shaped ("cupuliform") profile (where the rate at which the diameter of the passage increases along the passage decreases along the passage, i.e. decreasing divergence along the passage). The ability of the flared convection chimney to cool the light head 2 effectively can allow the module 22 to operate at a higher power and, thus, provide higher light intensities, up to 700 lm or even greater. In tests, after 500 hours of constant operation, the temperature of the light head 2 does not rise above 45° C. while producing about 700 lm of light. Conventional light emitting diode light heads of similar size can only deliver up to about 450 lm of light, for example using a single 10 W 'super' light emitting diode or three 3 W light emitting diodes. Thus, the convection chimney allows the light head 2 to run at greater power and thereby generate more light.

Figure 9:
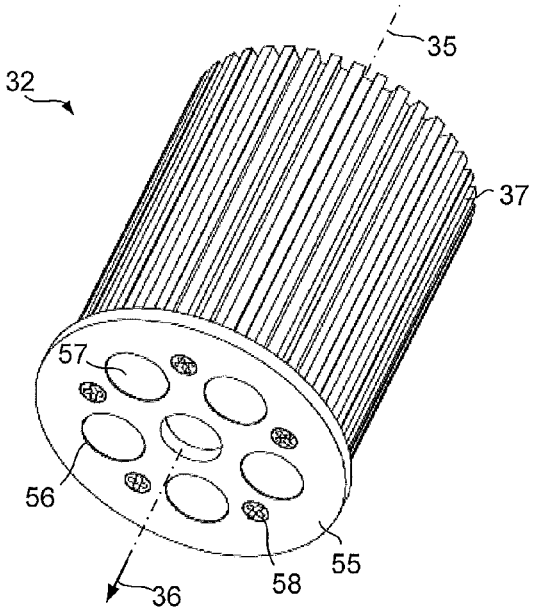
FIG. 9 is a perspective view, from below, of the light head shown in FIG. 8.
Figure 10:
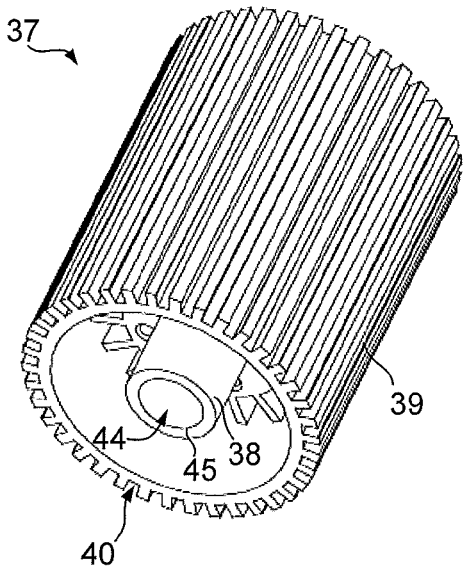
FIG. 10 is a perspective view, from below, of the body of the light head shown in FIG. 8.
Figure 11:
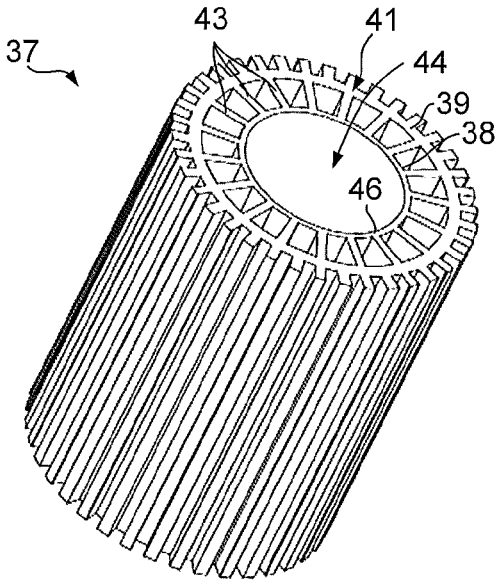
FIG. 11 is a perspective view, from above, of the body of the light head shown in FIG. 8.
Figure 12:
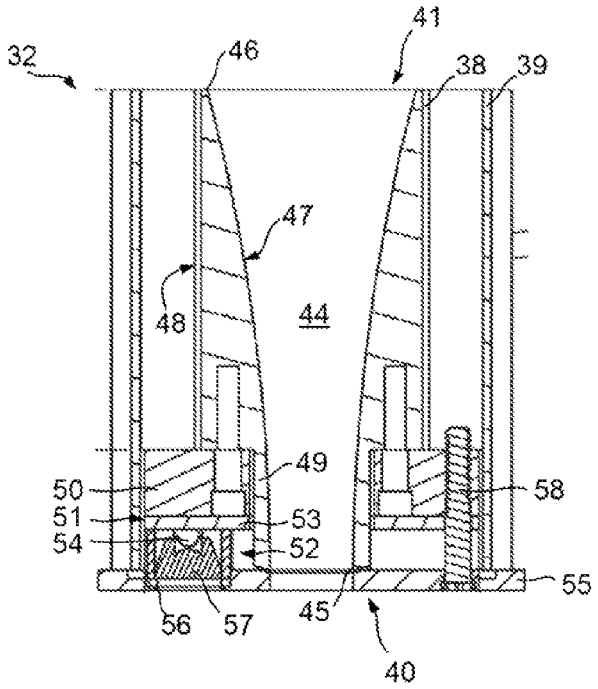
FIG. 12 is a sectional view of the light head shown in FIG. 8.
Figure 13:
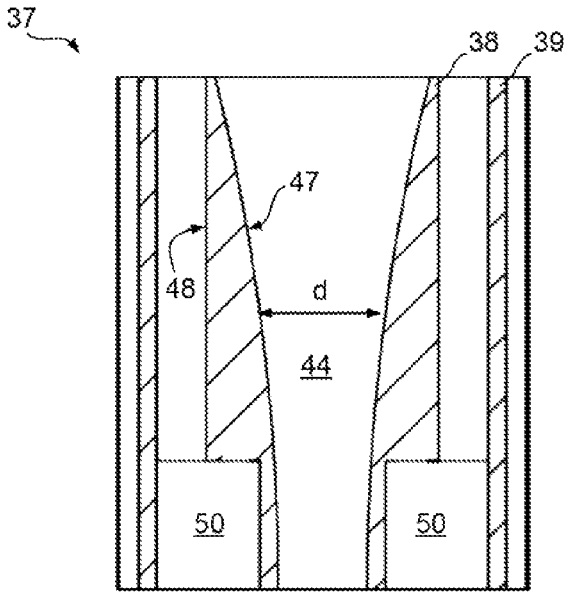
FIG. 13 is a sectional view of the body of the light head shown FIG. 8.

Referring to FIG. 9, another luminaire 31 in the form of a ceiling light is shown. The luminaire 31 includes first and second cylindrically light heads 32 housed in a rectangular box 33 having respective first and second openings 34 for the light heads 32. The light heads 32 are pivotably held within the box 33 and can be tilted to an angle, $\alpha$, between about −30° and +30° from vertical (0°).

Referring also to FIGS. 10 to 14, a light head 32 will be described in more detail. The light head 32 has a central axis 35 and emits light generally along the central axis 35 in a forwards direction 36.

The light head 32 includes a body 37 formed from extruded aluminium which is subsequently machined using a lathe. The body 37 is generally cylindrical having concentric inner and outer tubes 38, 39 which extend between front and rear ends 40, 41. The inner tube 38 has an outer diameter of about 26 mm and the outer tube 39 has an outer diameter of about 43 mm. The inner and outer tubes 38, 39 both have a height (or length) of about 58 mm. The outer tube 39 is ribbed on its outer surface 42 along its length between front and rear ends 40, 41. The body 37 also includes angularly-spaced radial support members 43 connecting the inner and outer tubes 38, 39.

The inner tube 38 defines a central passage 44 through the middle of the light head 32 between first and second openings 45, 46. An inner surface 47 of the inner tube 38 is machined to provide a trumpet-like profile. The passage 44 is relatively narrow at the first opening 45 at the front end 40 of the light head 32 and relatively wide at the second opening 46 at the back end 47 of the light head 32. The first opening 45 has a diameter of about 10 mm and the second opening 46 has a diameter of about 25 mm. The passage 44 has a length of about 58 mm. Thus, passage 44 is non-linearly flared having a diameter which increases smoothly and monotonically from the front end 40 to the back end 41 of the light head 32. The outer surface 48 of the inner tube 38 has a constant diameter, except proximate to the front end 40 of the light head 32 where, the outer surface has a step which forms a neck 49 and contributes to forming an annular space 50 for accommodating an annular thermally conductive backing plate or block 51 and a light source module 52. The light source module 52 includes a circuit board 53 which supports light emitting diodes 54. The module 52 is covered by a face plate 55 made of aluminium having apertures 56. The light emitting diodes 54 are covered by respective lenses 57 for collimating light to a given beam angle. The face plate 55 is annular and does not cover the front opening 45. The module 52, backing plate 51 and face plate 55 are secured to the body 37 by screws 58.

The flared passage 44 serves the same function as the flared passage 13 (FIG. 2) described earlier, namely providing a convection chimney for cooling the light head 26 in which heated air can flow up the convection chimney.

It will be appreciated that many modifications can be made to the embodiments hereinbefore described.

For example, the passage need not be circular in cross section, but can be, for example, rectangular or square, thus having four walls. The passage can have any (non-linear) flared or trumpet-like profile, i.e. a profile generally having a gradient which decreases going along the passage so that the passage opens up. The profile and aspect ratio (i.e. maximum width to length) of the passage can be optimized to maximise cooling. The wall (or walls) of the passage can be prepared, e.g. polished, to facilitate air flow and, thus, cooling. The openings can be larger or smaller, although the difference in size between the air inlet and air outlet is preferably maximised.

The luminaire can have more than one convection chimney. The convection chimney can take the form of a ring.

The light sources can be halogen lamps.

The body of the light head can be made from other materials having a high value of thermal conductivity (i.e. generally greater than 100 W $m^{-1}$ $K^{-1}$), such as copper, silver or gold, and which are preferably pure.

The luminaire can be any type of indoor luminaire, such as a reading lamp, table lamp, floor lamp, ceiling light, wall light spot light or other type of lamp or light suitable for down lighting. The luminaire can be an outdoor luminaire.

The invention claimed is:

1. A light head comprising:

a body for supporting a light source module;

wherein the body is configured to provide a central, trumpet-shaped passage passing through the body for cooling the light head, the passage having an inner surface (12; 47) which is smooth and continuous, wherein the body or the part of the body defining the passage is formed from a material having a thermal conductivity of at least 100 W $m^{-1}K^{-}$, and wherein the body is adapted to receive the light source module outside the passage wherein the body is configured to receive a light source module at a position at or close to an end of the body and the passage becomes wider further away from the end of the body.

2. A light head according to claim 1, wherein the passage has openings at first and second ends of the body, wherein the opening at the second end which is at least four times the area of the opening at the first end of the body.

3. A light head according to claim 1, wherein the passage has openings at first and second ends of the body, wherein the opening at the second end which is at least nine times the area of the opening at the first end of the body.

4. A light head according to claim 1, wherein the passage has openings at first and second ends of the body, wherein the opening at the second end which is at least sixteen times the area of the opening at the first end of the body.

5. A light head according to claim 1, wherein the passage has a length, a maximum width and an aspect ratio, which is calculated by dividing the length by the maximum width, which does not exceed about 3.

6. A light head according to claim 1, wherein the passage has a length, a maximum width and an aspect ratio, which is calculated by dividing the length by the maximum width, which does not exceed about 2.5.

7. A light head according to claim 1, wherein the body or the part of the body defining the passage is polished.

8. A light head according to claim 1, wherein the material is aluminium.

9. A light head according to claim 1, wherein the body comprises a demi-toroidal shell which defines the passage.

10. A light head according to claim 1, wherein the body comprise a cylinder.

11. A light head according to claim 1, wherein the body has a recess and/or securing points for receiving the light source module.

12. A light head according to claim 1, further comprising:

a light source module received and thermally anchored to the body.

13. A light head according to claim 12, wherein the light source module comprises a circuit board supporting at least one light source.

14. A light head according to claim 13, wherein the at least one light source comprises a plurality of light emitting diodes and, optionally 5, 6 or 7 light emitting diodes.

15. A light head according to claim 11, capable of producing at least 60 lumens per Watt.

16. A luminaire comprising a light head according to claim 1.

17. A luminaire according to claim 16, which is a balanced-arm lamp.

18. A luminaire according to claim 16, which is a ceiling or wall-mounted lamp.

* * * * *

UNITED STATES PATENT AND TRADEMARK OFFICE

CERTIFICATE OF CORRECTION

PATENT NO. : 9,206,973 B2
APPLICATION NO. : 13/809727
DATED : December 8, 2015
INVENTOR(S) : Simon Fussell It is certified that error appears in the above-identified patent and that said Letters Patent is hereby corrected as shown below:

In the Claims

In column 5, line 14 (claim 1, line 9), "$K^{-}$" should be --$K^{-1}$--.

Signed and Sealed this
Third Day of May, 2016

Michelle K. Lee

Michelle K. Lee
*Director of the United States Patent and Trademark Office*